US008550003B2

(12) United States Patent
Cameron

(10) Patent No.: US 8,550,003 B2
(45) Date of Patent: Oct. 8, 2013

(54) PYROTECHNIC DEVICE

(76) Inventor: Rodney Neil Cameron, Abbotsford (CA)

( * ) Notice: Subject to any disclaimer, the term of this patent is extended or adjusted under 35 U.S.C. 154(b) by 0 days.

(21) Appl. No.: 12/662,598

(22) Filed: Apr. 26, 2010

(65) Prior Publication Data

US 2011/0259229 A1 Oct. 27, 2011

(51) Int. Cl.
*F42B 4/02* (2006.01)
*F42B 4/24* (2006.01)

(52) U.S. Cl.
USPC ..... 102/360; 102/335

(58) Field of Classification Search
USPC ..... 102/335, 360, 361, 368, 370, 367, 102/369
See application file for complete search history.

(56) References Cited

U.S. PATENT DOCUMENTS

| | | | | | |
|---|---|---|---|---|---|
| 619,177 | A | * | 2/1899 | Hinton | 102/361 |
| 1,773,197 | A | | 8/1930 | Mulcahy | |
| 1,886,407 | A | | 11/1932 | Kohn | |
| 3,744,419 | A | | 7/1973 | Hand | |
| 3,749,018 | A | * | 7/1973 | Germershausen | 102/361 |
| 4,052,940 | A | * | 10/1977 | Gits et al. | 102/361 |
| 4,291,623 | A | | 9/1981 | Robinson et al. | |
| 4,353,301 | A | * | 10/1982 | Jacobsen | 102/334 |
| 4,448,130 | A | | 5/1984 | Speer | |
| 4,566,388 | A | | 1/1986 | Loyd, Jr. | |
| 4,697,518 | A | | 10/1987 | Lau et al. | |
| 4,976,201 | A | * | 12/1990 | Hamilton | 102/323 |
| 5,046,563 | A | | 9/1991 | Engel et al. | |
| 5,343,808 | A | | 9/1994 | Collar | |
| 5,423,264 | A | * | 6/1995 | Siegler et al. | 102/342 |
| 5,954,563 | A | * | 9/1999 | Spriggs | 446/475 |
| D429,516 | S | | 8/2000 | Wu et al. | |
| 6,792,866 | B2 | | 9/2004 | Grattan | |
| 6,899,033 | B2 | * | 5/2005 | Marietta | 102/361 |
| 6,912,958 | B2 | * | 7/2005 | Marietta | 102/346 |
| 7,096,790 | B1 | | 8/2006 | Wah | |
| 7,278,355 | B2 | | 10/2007 | Yu | |
| 8,136,437 | B2 | * | 3/2012 | Van Stratum et al. | 86/1.1 |
| 2003/0070539 | A1 | | 4/2003 | Widmann | |
| 2004/0217020 | A1 | | 11/2004 | Price et al. | |

FOREIGN PATENT DOCUMENTS

| | | | |
|---|---|---|---|
| CN | 2202907 | Y | 7/1995 |
| CN | 1325013 | A | 12/2001 |
| CN | 2804782 | Y | 8/2006 |
| CN | 201069343 | Y | 6/2008 |
| CN | 201129978 | Y | 10/2008 |
| CN | 201152722 | | 11/2008 |
| ES | 261 826 | | 7/1982 |
| GB | 2 300 901 | | 11/1996 |
| JP | 2005042998 | A | 2/2005 |

OTHER PUBLICATIONS

PCT/CN2011/000719 International Search Report issued by The State Intellectual Property Office, the P.R. China on Aug. 4, 2011.

* cited by examiner

*Primary Examiner* — James Bergin
(74) *Attorney, Agent, or Firm* — Richard D. Okimaw

(57) ABSTRACT

A pyrotechnic device comprising an outer casing having a bore therein, a central sleeve extending from the bore into an interior of the outer casing and an insert having a burst explosive charge therein sized to be capable of being slidably received within the central sleeve.

18 Claims, 5 Drawing Sheets

PYROTECHNIC DEVICE

BACKGROUND OF THE INVENTION

1. Field of Invention

The present invention relates to pyrotechnic devices in general and in particular to a method and apparatus of forming a pyrotechnic device that is safer to store and transport.

2. Description of Related Art

Pyrotechnic devices or fireworks are well known and typically comprise a projectile launched from a tube or mortar. Such devices are formed of a casing containing an explosive or burst charge and at least one fireworks effect, such as stars sparklers and the like therein. In conventional fireworks, the burst charge and fireworks effects are typically contained within a common chamber within the casing.

In operation, fireworks shells are launched into the air by a lift explosive charge contained within the mortar either loosely or attached to a bottom of the shell. The fireworks shell includes a time delay fuse which may be ignited by the lift charge so as to ignite the burst charge at a desired height. Fireworks shells rely upon a combination of the burst charge contained within them to ignite and distribute the fireworks effects contained for display to observers.

Conventional fireworks rely upon both the burst charge and the shell wall or casing to produce a sufficient dispersion of the fireworks effect. Conventionally, low explosive compounds are utilized such that the rate of decomposition is insufficient alone to produce the required dispersal of the fireworks effects. Examples of such low explosives are black powder based or flash or aluminum based charges. Accordingly, the casing of the fireworks serves to confine the initial deflagration of the explosive compound until a sufficient pressure has developed within the shell to rupture it and thereafter the developed pressure serves to disperse the fireworks effects as desired.

Current difficulties exist in the usage, storage and transportation of conventional fireworks. Due to the potentially explosive nature of such devices, national and international regulations require minimum standards for containment and safe distances required to be maintained around fireworks.

SUMMARY OF THE INVENTION

According to a first embodiment of the present invention there is disclosed a pyrotechnic device comprising an outer casing having a bore therethrough, a central sleeve extending from the bore into an interior of the outer casing and an insert having a burst explosive charge therein sized to be capable of being slidably received within the central sleeve.

The outer casing may have a wall strength selected to constrain and compress the decomposition a burst charge contained therein. The outer casing may be formed of first and second complementary casing portions. The outer casing may be substantially spherical.

The first and second casing portions may comprise substantially equal hemispheres wherein the first and second casing portions are connected to each other along a plane bisecting the polytechnic device. The outer casing may be substantially cylindrical having an axis wherein the central sleeve extends along the axis.

The bore may be located in the first casing portion. The first casing portion may include a first cylinder extending from the bore into the cavity. The second casing portion may include a second cylinder extending therefrom into the cavity alignable along a common axis with the first cylinder when the first and second casing portions are secured to each other. The end portion of the second cylinder may overlap an end portion of the first cylinder and form the central sleeve.

The outer casing and the central sleeve may form an annular cavity therebetween. The annular cavity may contain at least one substance capable of producing a fireworks effect.

The insert may be securable within the central sleeve by a retainer selected from the group consisting of tape, clips or glue. The insert may comprise an elongate cylindrical body having a wall thickness selected to be easily ruptured so as to not constrain and compress the decomposition a burst charge contained therein.

The insert may extend between first and second end plugs and include the burst charge in a central portion thereof. The insert may include at least one fireworks effect between the burst charge and the first and second end plugs. The insert may include a time delay fuse extending from the burst charge and through the first end plug to an exterior of the insert.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
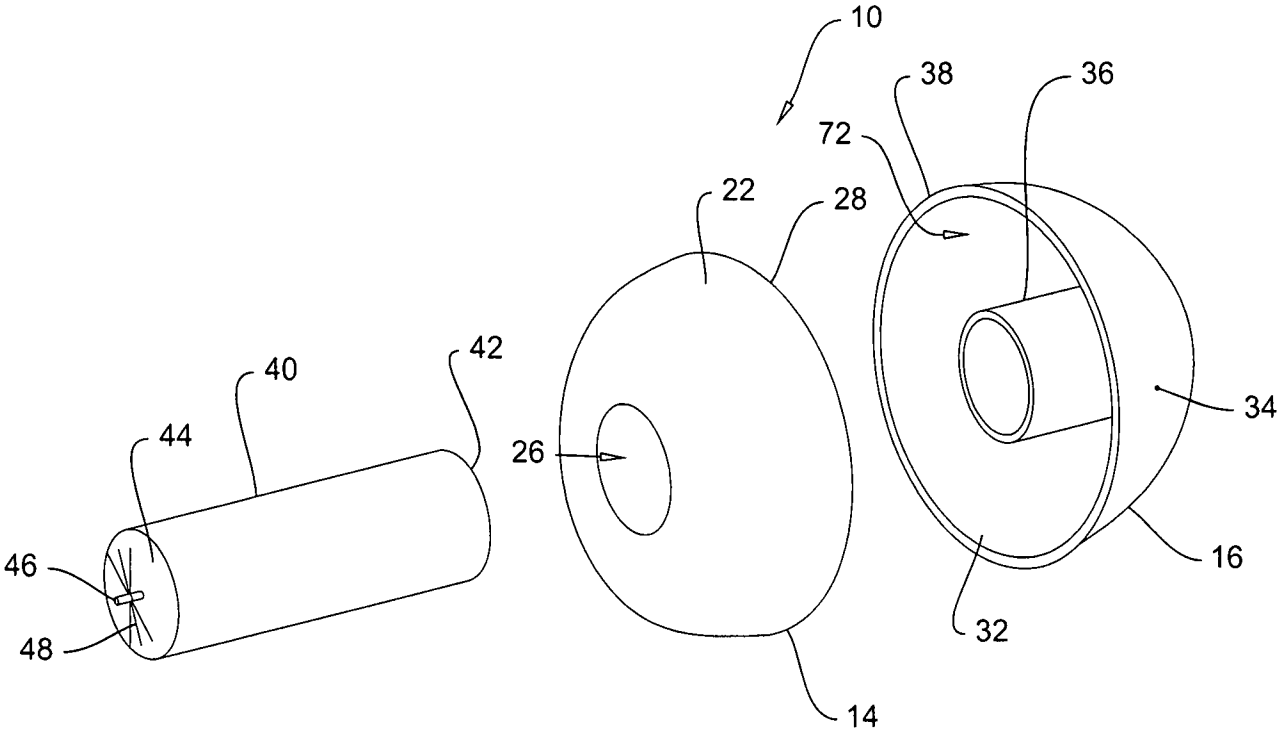
FIG. 1 is an exploded perspective view of a pyrotechnic device according to a first embodiment of the present invention.

Referring to FIG. 1, a pyrotechnic device according to a first embodiment of the invention is shown generally at 10. Such a device may be a fireworks shell or other similar pyrotechnics devices. The device 10 comprises a casing body 12 and an insert 40 locatable therein. The casing body 12 may be formed of first and second casing portions, 14 and 16, respectively, matable together to form the casing body 12. The casing body 12 may have a diameter selected to correspond to common pyrotechnics sizes or calibres.

As illustrated the casing body 12 may have a substantially spherical shape as are conventionally known however, it will be appreciated that other shapes may also be utilized such as cylindrical by way of non-limiting example. The first and second casing portions 14 and 16 forming the casing body 12 each comprise hemispheres of the casing body 12 being joined along a plane generally indicated at 25 bisecting the sphere. In such embodiments, each of the first and second casing portions 14 and 16 are substantially similar to each other comprising symmetric halves of the sphere formed by the casing body 12. It will also be appreciated that in other embodiments, the first and second casings portions 14 and 16 may optionally comprise asymmetric portions forming the casing body 12.

Figure 2:
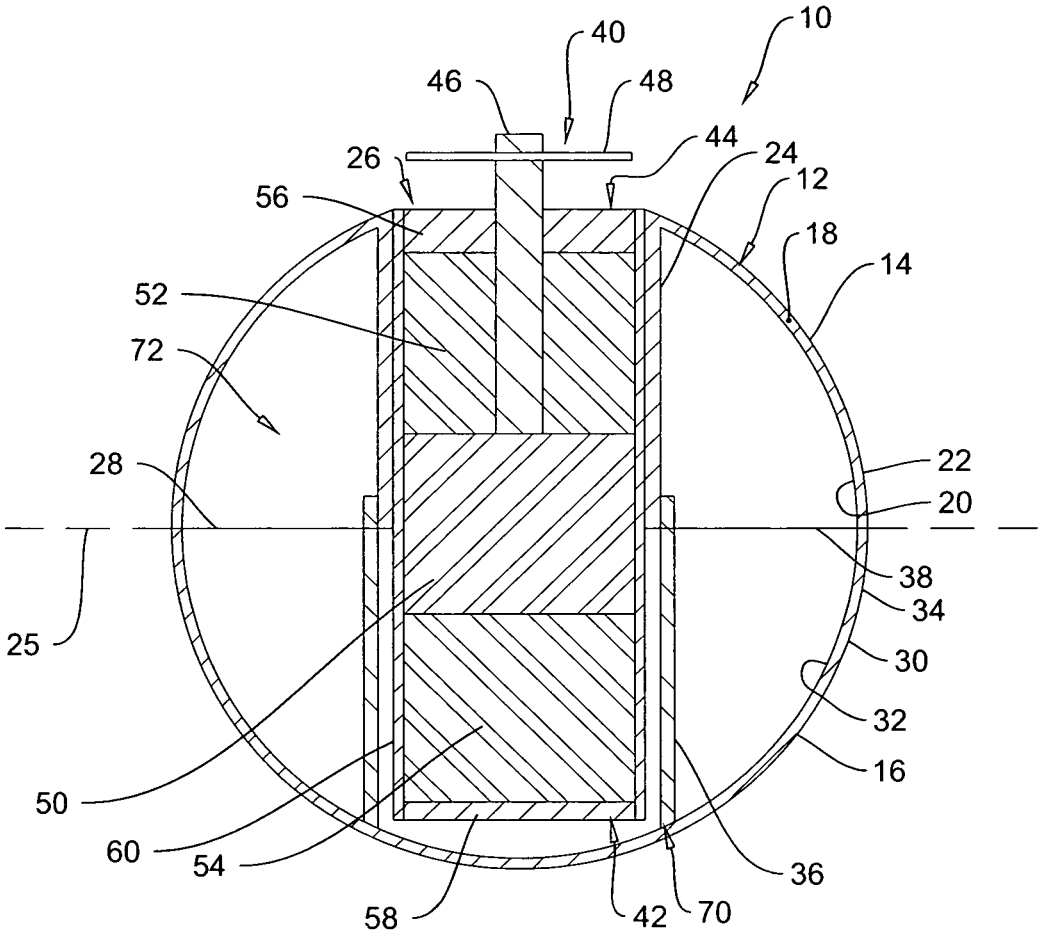
FIG. 2 is a cross sectional view of the pyrotechnic device of FIG. 1 taken along the line 2-2.

With reference to FIG. 2, the first casing portion 14 comprises a first semi-spherical outer casing wall 18 having an inner and outer surface 20 and 22, respectively and a first cylinder 24 extending from the inner surface 20. The outer surface 22 is formed to have a desired diameter or calibre. The first outer casing wall has a bore 26 extending therethrough and a first edge 28. As illustrated in FIG. 2, the first cylinder 24 extends from the bore 26 such that the first cylinder 24 forms a continuation of the bore and has a common opening cross-section therewith. The first cylinder 24 may extend to the bisecting plane 25 in common with the first edge 28 of the first casing portion 14.

The second casing portion 16 comprises a second semi-spherical outer casing wall 30 extending from a second edge 38 having inner and outer surface, 32 and 34, respectively and a second cylinder 36 extending from the inner surface 32. The second cylinder 36 may extend to a position past the bisecting plane 25 so as to surround and overlap the first cylinder as illustrated in FIG. 2.

The first and second casing portions 14 and 16 are formed of conventional materials for a fireworks shell, such as, by way of non-limiting example, cardboard, paper, pasteboard or plastic. The first and second cylinders 24 and 36 may be formed of paper, cardboard, pasteboard and other common pyrotechnic device forming materials.

The first and second casing portions 14 have a thickness selected depending upon the size of the device 10 and the material so as to provide compression to an explosive burst charge contained therein as is common in the art. By way of non-limiting example, a 5.9 inch (150 mm) diameter pyrotechnics device may have a first and second casing portion 14 and 16 wall thickness of between 0.04 and 0.6 inches (1 and 15 mm) formed of paper, cardboard or plastic depending upon the bust charge and desired explosion. The first and second cylinders 24 and 36 are formed to have a substantially reduced thickness and strength as compared to the first and second casing portions 14 and 16 thickness and strength and do not significantly add any ability to contain and compress the combustion of a material therein. The first and second cylinders 24 and 36 therefore serve to define keep fireworks effects out of the central sleeve only.

The first and second casing portions 14 and 16 may be mated together to form a casing body 12 as illustrated in FIG. 1. When assembled, the first and second cylinders 24 and 36 will form a central sleeve 70 extending from the bore 26. Furthermore, the first and second casing portions 14 and 16 and the central sleeve 70 define an annular cavity 72 therebetween which may be filled with fireworks effects and the like for distribution upon ignition of the burst charge as will be further described below.

The insert 40 comprises a substantially cylindrical body extending between first and second ends, 42 and 44, respectively. A time delay fuse 46, as are commonly known in the art having a cross match 48 extends axially from the first end 42 thereof. As illustrated in FIG. 2, the insert 40 may have a burst charge 50 located in a central portion thereof and fireworks effects 52 and 54 located adjacent to the burst charge. The insert 40 includes first and second plugs, 56 and 58, respectively formed of clay or cardboard as are commonly known in the art at opposed first and second ends 42 and 44 of the insert. The insert may be formed from a cylindrical tube 60 which is then filled with the first and second plugs 56 and 58, fireworks effects 52 and 54 and burst charge 50. The fireworks effects 52 and 54 may comprise stars, sparklers, crackle or component effect or any other known type of fireworks effects. In other embodiments, the fireworks effects may be omitted from the insert wherein the majority of the insert contains the burst charge 50.

The burst charge 50 may be selected from any commonly known pyrotechnics material such as black powder or aluminum based explosives. It will therefore be seen that the choice of burst charge materials may be selected such that the rate of decomposition is insufficient in itself to create an explosive effect. The tube 60 is formed of paper or other common pyrotechnics materials and has a thickness so as to be readily frangible or ruptured. Accordingly, the tube 60 will not add significant strength to the insert and will therefore not significantly constrain the propagation of the deflagration of the burst charge. It is well known that for low explosive materials in which the rate of decomposition travels slower than the speed of sound through the material, that resulting decomposition will not result in an explosion if the decomposition is largely unconstrained. In this way it will be seen that if the burst charge 50 within the insert 40 is ignited and is unconstrained by any other structures, the resulting decomposition will not result in an explosion but rather as a rapid burn. Similarly, when an insert 40 is not located within the casing body 12, any decomposition of a composition within the casing body may easily rupture the central sleeve 70 and be vented through the bore 26 so as to not develop a sufficient pressure to explode as well.

Conversely, when the insert 40 is located within the casing body 12 as illustrated in FIG. 2, the casing body 12 serves to constrain the decomposition of the burst charge until a sufficient pressure has developed within the casing body 12 so as to burst the casing body 12. It will be appreciated that due to the greater strength of the casing body 12, the resulting pressure developed by constraining the decomposition of the burst charge 50 therein will therefore produce the desired explosion when that pressure is released due to the failure of the casing body. Such an explosion is the desired result of a fireworks or pyrotechnics shell and may therefore by the present structure be limited to occurring only when the device has been assembled by inserting the insert 40 and not under any undesired conditions. It will also be appreciated that the first and second plugs 56 and 58 will further serve to retain the insert 40 within the central sleeve 70 of the casing body 12. The first plug 56 substantially encloses the bore 26 while the second plug 58 balances the force upon the insert as the burst charge 50 is ignited so as to balance the force of that ignition upon the first plug 56.

Figure 3:
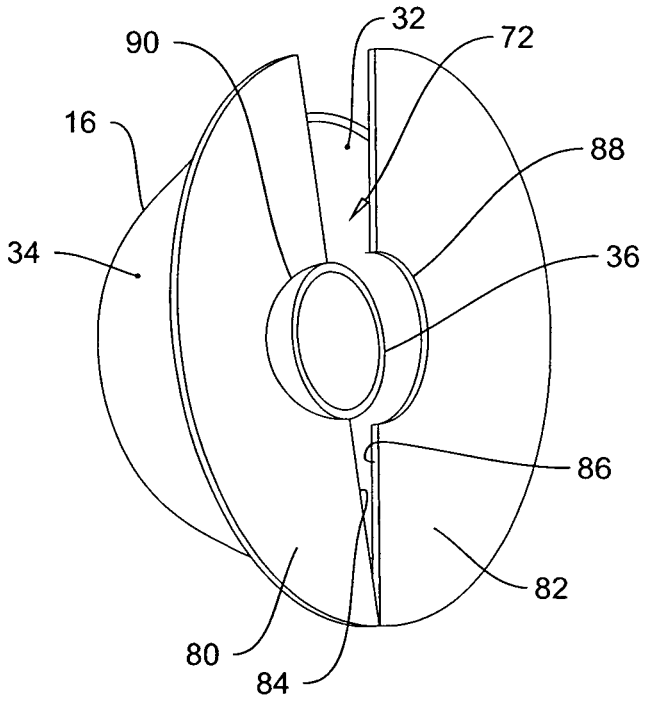
FIG. 3 is a perspective view of a first casing portion of the pyrotechnic device of FIG. 1 having assembly discs applied thereto.
Figure 4:
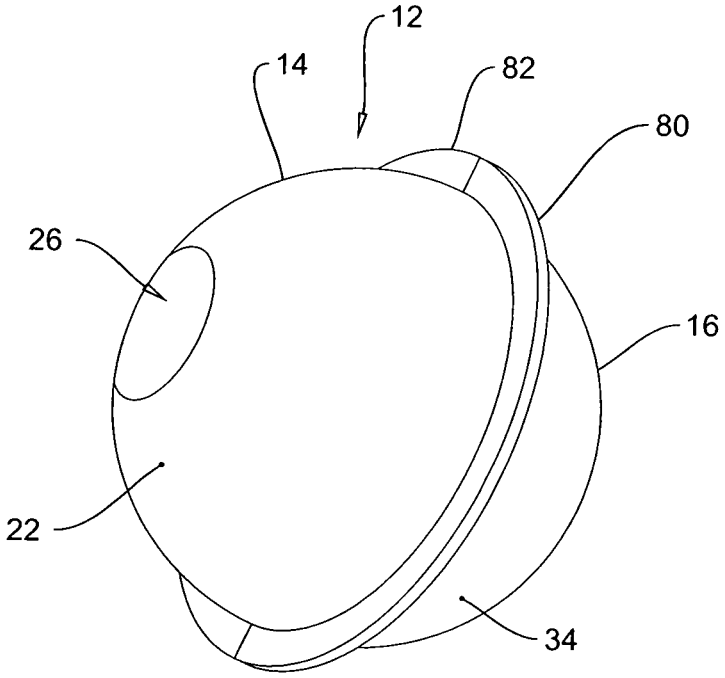
FIG. 4 is a perspective view of the assembled first and second casing portions of the pyrotechnic device of FIG. 1 having the assembly discs therein.

Turning now to FIG. 3, the casing body 12 may be formed by filling the annular cavity 72 of each shell portion with the desired fireworks effects and the like. Each shell portion may be filled to the bisecting plane 25 so as to substantially fill that shell portion annular cavity. First and second planar sheets of material, 80 and 82, respectively may then be located over the annular cavity 72. As illustrated in FIG. 3, the first and second sheets are applied to the second casing portion 16, although it will be appreciated that they may also be applied to the first casing portion 14 as well. The first and second sheets 80 and 82 each have edge surfaces 84 and 86, respectively, with notches, 88 and 90, respectively, therein sized and shaped to engage each other and closely surround the second cylinder 36 for applications to the second casing portion 16. The first and second sheets 80 and 82 enclose the annular cavity and retain the fireworks effects therein when the first and second casing portions 14 and 16 are mated together as illustrated in FIG. 4. Thereafter, the first and second sheets 80 and 82 may be slidably removed and the first and second shell portions joined the first and second edges 28 and 38. The first and second casing portions 14 and 16 may be secured to each other by any commonly known method, such as, by way of non-limiting example, papering and gluing or through the use of nesting sets.

The assembled casing body 12 and insert 40 may be shipped and stored separately from each other. When a user desires to utilize a device, they may insert the insert 40 into the bore 26 and secure it therein by the use of tape, clips, glue, friction and the like so as to retain the insert within the bore against the centrifugal forces upon the shell and insert as the shell is launched from a mortar. The resulting device may then be placed within mortar and subsequently propelled into the air. It can be seen that the user may also have the ability to select different shell casing bodies 12 having differing loads of fireworks effects within the annular cavity 72 and match them with different inserts 40 having differing burst charges and fireworks effects so as to customize the desired fireworks display.

Figure 5:
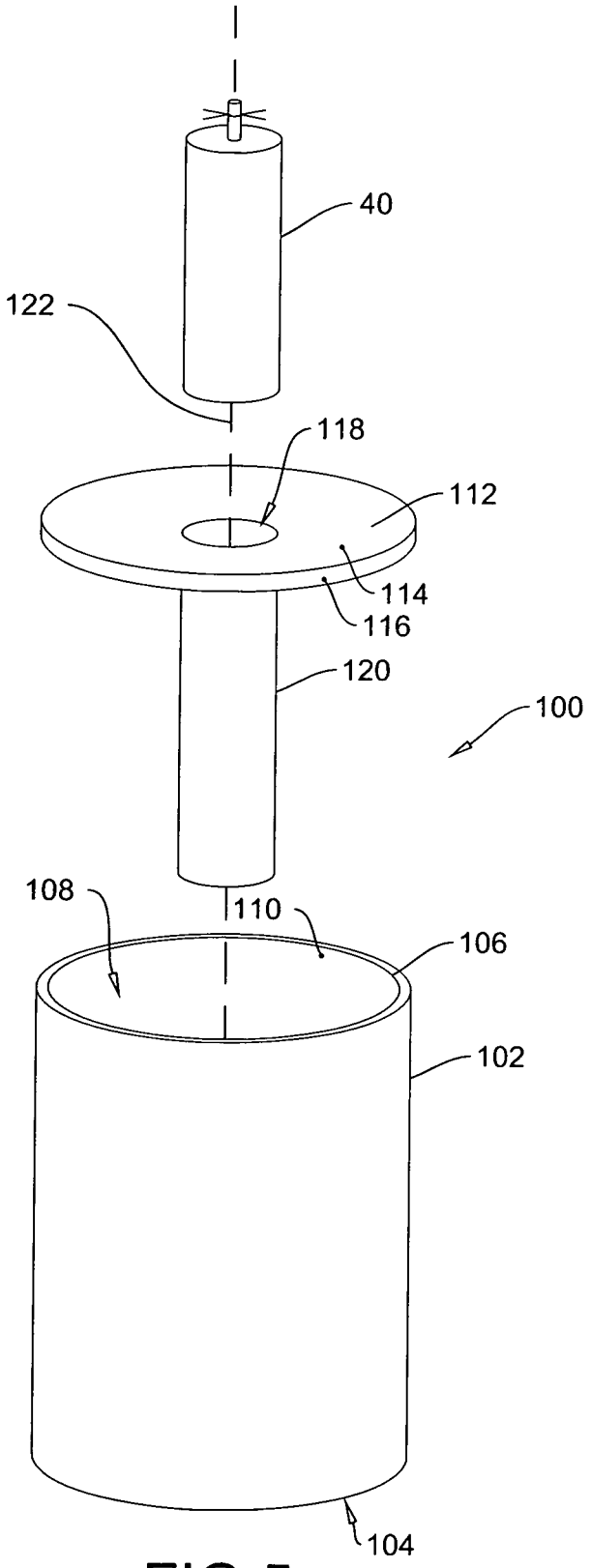
FIG. 5 is an exploded perspective view of a pyrotechnic device according to a further embodiment of the present invention.

Turning now to FIG. 5, an alternative embodiment for forming a cylindrical shell 100 is illustrated. The cylindrical shell 100 is formed of a cylindrical body 102 having a closed bottom 104 and an open top 106 defining a cavity 108 therein. The top of the cavity 108 has an annular wall 110 to receive a cover 112 therein. The cover 112 may also be abutted against the top 106 of the cylindrical body 102. The cover 112 comprises a substantially planar disk shaped planar member 114 having an annular edge 116 and a central bore 118 therethrough. A cylindrical sleeve 120 extends from the central bore 118 and is sized to receive an insert 40 as described above therein. It will also be appreciated that the cylindrical sleeve 120 may extend from the closed bottom 104 within the cavity 108 of the cylindrical body 102 such that the cover 112 comprises an annular ring extending between the cylindrical body 102 and the cylindrical sleeve 120. The cylindrical sleeve 120 may also extend from a bore in the bottom 104 of the cylindrical body 102 wherein the cover 112 comprises a solid disk to enclose the cavity 108. As illustrated the cylindrical sleeve 120 extends along a central axis 122 in common with the cylindrical body 102, although it will be appreciated that the cylindrical sleeve may also be mounted off-axis as well.

While specific embodiments of the invention have been described and illustrated, such embodiments should be considered illustrative of the invention only and not as limiting the invention as construed in accordance with the accompanying claims.

What is claimed is:

1. A pyrotechnic device comprising:

an outer casing adapted to be air launched having a wall strength selected to constrain and compress the decomposition a burst charge contained therein and a bore therethrough;

a central sleeve extending from said bore into an interior of said outer casing; and an insert comprising a tube formed of a frangible material having a burst explosive charge therein so as to permit substantially unconstrained expansion of said burst charge, said tube being sized to be capable of being slidably received within said central sleeve.

2. The pyrotechnic device of claim 1 wherein said outer casing is formed of first and second complementary casing portions.

3. The pyrotechnic device of claim 2 wherein said outer casing is substantially spherical.

4. The pyrotechnic device of claim 3 wherein said first and second casing portions comprise substantially equal hemispheres wherein said first and second casing portions are connected to each other along a plane bisecting said casing.

5. The pyrotechnic device of claim 2 wherein said outer casing is substantially cylindrical having an axis wherein said central sleeve extends along said axis.

6. The pyrotechnic device of claim 2 wherein said bore is located in said first casing portion.

7. The pyrotechnic device of claim 6 wherein said first casing portion includes a first cylinder extending from said bore into said cavity.

8. The pyrotechnic device of claim 7 wherein said second casing portion includes a second cylinder extending therefrom into said cavity alignable along a common axis with said first cylinder when said first and second casing portions are secured to each other.

9. The pyrotechnic device of claim 8 wherein an end portion of said second cylinder overlaps an end portion of said first cylinder and form said central sleeve.

10. The pyrotechnic device of claim 1 wherein said outer casing and said central sleeve form an annular cavity therebetween.

11. The pyrotechnic device of claim 10 wherein said annular cavity contains at least one substance capable of producing a fireworks effect.

12. The pyrotechnic device of claim 1 wherein said tube of said insert is securable within said central sleeve by a retainer selected from the group consisting of tape, clips or glue.

13. The pyrotechnic device claim 1 wherein said tube comprises an elongate cylindrical body having a wall thickness selected to be easily ruptured so as to not constrain and compress the decomposition a burst charge contained therein.

14. The pyrotechnic device of claim 13 wherein said insert extends between first and second end plugs and includes said burst charge in a central portion thereof.

15. The pyrotechnic device of claim 14 wherein said insert includes at least one fireworks effect within said tube between said burst charge and said first and second end plugs.

16. The pyrotechnic device of claim 15 wherein said insert includes a time delay fuse extending from said burst charge and through said first end plug to an exterior of said insert.

17. The pyrotechnic device of claim 1 wherein outer casing is formed of a material selected from the group consisting of paper, cardboard and plastic with a wall thickness of between 0.04 and 0.6 inches.

18. The pyrotechnic device of claim 17 wherein tube of said insert is formed of paper having a thickness selected to permit substantially unconstrained expansion of said burst charge.

* * * * *